US012071275B2

(12) United States Patent
Singh

(10) Patent No.: US 12,071,275 B2
(45) Date of Patent: Aug. 27, 2024

(54) NOVELTY DRINKING VESSEL

(71) Applicant: Kulbinder Singh, London (GB)

(72) Inventor: Kulbinder Singh, London (GB)

( * ) Notice: Subject to any disclaimer, the term of this patent is extended or adjusted under 35 U.S.C. 154(b) by 0 days.

(21) Appl. No.: 18/201,783

(22) Filed: May 25, 2023

(65) Prior Publication Data

US 2023/0382596 A1 Nov. 30, 2023

(30) Foreign Application Priority Data

May 30, 2022 (GB) ..... 2207949

(51) Int. Cl.

| | |
|---|---|
| ***A47G 19/22*** | (2006.01) |
| ***A47G 21/04*** | (2006.01) |
| ***B65D 25/20*** | (2006.01) |
| ***B65D 25/28*** | (2006.01) |

(52) U.S. Cl.

CPC ..... *B65D 25/20* (2013.01); *A47G 19/2205* (2013.01); *A47G 21/04* (2013.01); *B65D 25/2885* (2013.01)

(58) Field of Classification Search

CPC ..... A47G 19/2227; A47G 2019/2238; A47G 2019/2244; A47G 2019/225; A47G 2200/08; B65D 2203/12; B65D 81/3876; B65D 25/20

USPC ..... 206/459.1, 217, 457, 216; 362/154

See application file for complete search history.

(56) References Cited

U.S. PATENT DOCUMENTS

| | | | | |
|---|---|---|---|---|
| 2005/0079479 | A1* | 4/2005 | Chen | G09F 23/08 434/409 |
| 2012/0067904 | A1* | 3/2012 | Richmond | B65D 81/3876 220/592.16 |
| 2015/0335183 | A1* | 11/2015 | Balachandran | G09F 3/02 206/459.1 |
| 2016/0286543 | A1 | 9/2016 | Putterman et al. | |

FOREIGN PATENT DOCUMENTS

| | | |
|---|---|---|
| GB | 2397934 A | 8/2004 |
| GB | 2592073 A | 8/2021 |

* cited by examiner

*Primary Examiner* — King M Chu
(74) *Attorney, Agent, or Firm* — Jose Cherson Weissbrot

(57) ABSTRACT

A drinking vessel comprising: a first attachment interface; an electronic display unit having a display screen and comprising a second attachment interface; and a remote control comprising remote control circuitry within a remote control housing; wherein: the first and second attachment interfaces are configured to cooperate to releasably attach the electronic display unit to the drinking vessel; the remote control is operable to wirelessly transmit instructions to the electronic display unit, including instructions relating to the content displayed on the display screen; the remote control housing is resistant to ingress of liquid when submerged in liquid at least up to the maximum depth containable by the drinking vessel; and the remote control housing is resistant to heat so as to protect the remote control circuitry from damage when the remote control housing is submerged in liquids heated to up to 100 degrees Celsius.

9 Claims, 3 Drawing Sheets

NOVELTY DRINKING VESSEL

FIELD OF THE INVENTION

The invention relates to a novelty drinking vessel with an electronic display unit and a remote control. In particular, the invention relates to a novelty drinking apparatus with an electronic display unit controllable by a remote control, said remote control being configured for use as a spoon.

BACKGROUND OF THE INVENTION

Drinking vessels are older than history, and come in all shapes and sizes. Most are purely utilitarian, such as basic glass tumblers or ceramic mugs. Others are highly decorated for ceremonial purposes, such as the chalices used in some religious liturgies. Still others are designed to amuse or entertain, adding novelty to the experience of drinking.

One example of a novelty drinking vessel is shown in US2018042417, which discloses a container sleeve apparatus for a drinking apparatus, comprising an illuminated transparent insert section which can be used to display a logo or other image. Such drinking vessels may be useful for marketing purposes by displaying a logo or brand information, or for entertainment by displaying the image of a celebrity or well-liked character. The versatility of this drinking vessel is limited, however, since only a single, static image can be displayed.

Another example of a novelty drinking vessel is shown in US20030122730, which discloses a system for actively displaying moving images on the side wall of a drinking vessel. The system comprises a drinking vessel with an electronic display unit embedded into a side wall. This display screen can be controlled by a remote control unit which is separate to the drinking vessel. The user experience of this drinking vessel is reduced because the remote control is a separate, functional unit serving no other purpose, thus detracting from the novelty and fun associated with using the drinking vessel. Furthermore, the remote control might easily be lost.

It is desirable to enhance the novelty and user experience of drinking vessels comprising remotely controllable electronic displays.

SUMMARY OF THE INVENTION

A first aspect of the invention provides a drinking vessel comprising: a first attachment interface; an electronic display unit having a display screen and comprising a second attachment interface; and a remote control comprising remote control circuitry within a remote control housing; wherein: the first and second attachment interfaces are configured to cooperate to releasably attach the electronic display unit to the drinking vessel; the remote control is operable to wirelessly transmit instructions to the electronic display unit, including instructions relating to the content displayed on the display screen; the remote control housing is resistant to ingress of liquid when submerged in liquid at least up to the maximum depth containable by the drinking vessel; and the remote control housing is resistant to heat so as to protect the remote control circuitry from damage when the remote control housing is submerged in liquids heated to up to 100 degrees Celsius.

In order to increase the synergy and integrated novelty experience when using the remote control and the drinking vessel with the attached electronic display unit, the remote control is configured for use as a drink stirrer. Thus, the remote control housing must be resistant to both liquid and heat, since stirrers are most commonly used for hot drinks.

In some embodiments, the remote control housing is sized and shaped as a spoon. In some such embodiments, the remote control housing is sized and shaped as a tea spoon.

It is not essential that the remote control housing be shaped as a spoon, although it is preferable in many cases. Wooden or plastic stirring sticks are also commonly used, both for 'take away' hot drinks, and for some cocktails, and so in some embodiments the remote control may be formed as a stirring stick.

In some embodiments, the drinking vessel comprises a third attachment interface, for the releasable attachment of the remote control housing to the drinking vessel. In other embodiments, the electronic display unit comprises a fourth attachment interface, for the releasable attachment of the remote control housing to the electronic display unit.

In order to reduce the likelihood of the remote control being lost, it is helpful to provide an attachment interface to either the drinking vessel or the electronic display unit, or both, for the remote control. There are many existing methods of releasably attaching a spoon or other stirrer to a drinking vessel, for example providing a slot through the handle of a cup, through which a spoon can be slotted.

In some embodiments, the remote control housing comprises a fifth attachment interface, for the releasable attachment of the remote control housing to the drinking vessel or to the electronic display unit or, if at least one is provided, to one of the third or fourth attachment interfaces.

Another approach to reducing the likelihood of the remote control being lost is to provide an attachment interface to the remote control housing itself. In such embodiments, the remote control may be attachable to any conventional drinking vessel, or any drinking vessel of the invention, even those lacking third and fourth attachment interfaces. Alternatively, the fifth attachment interface on of the remote control housing may be configured to engage with an attachment interface on the drinking vessel or on the electronic display unit, such as a third or fourth attachment interface.

In some embodiments, the remote control circuitry comprises a rechargeable battery and a charging circuit containing a thermoelectric semiconductor. The rechargeable battery is rechargeable in use by current generated by the thermoelectric semiconductor as it transfers heat from a first end of the remote control housing submerged in hot liquid to a second end of the remote control housing which is not submerged in hot liquid.

In some embodiments, the electronic display unit has an integral user interface. In the event that the remote control is not available, or the user chooses not to use it, the integral user interface provides an alternative or additional means of providing instructions to the electronic display unit, including instructions relating to a content to be displayed on the display screen.

In some such embodiments, the integral user interface comprises a tilt accelerometer. Thus, the user can provide instructions to the electronic display unit simply by tilting it. This may add to the novelty value of the apparatus by causing the content displayed on the display screen to change when the drinking vessel is tilted as the user drinks from it.

BRIEF DESCRIPTION OF THE DRAWINGS

An embodiment of the invention will now be described, by way of example only, with reference to the following drawings.

DETAILED DESCRIPTION

Throughout this specification, relative positional terms such as 'top', 'bottom', 'above', 'below', 'side', 'vertical', etc. may be used. Where this is the case, the reader should assume an orientation in which the drinking vessel is placed on a flat surface, in its in-use, at rest orientation, as depicted in the Figures.

Figure 1:
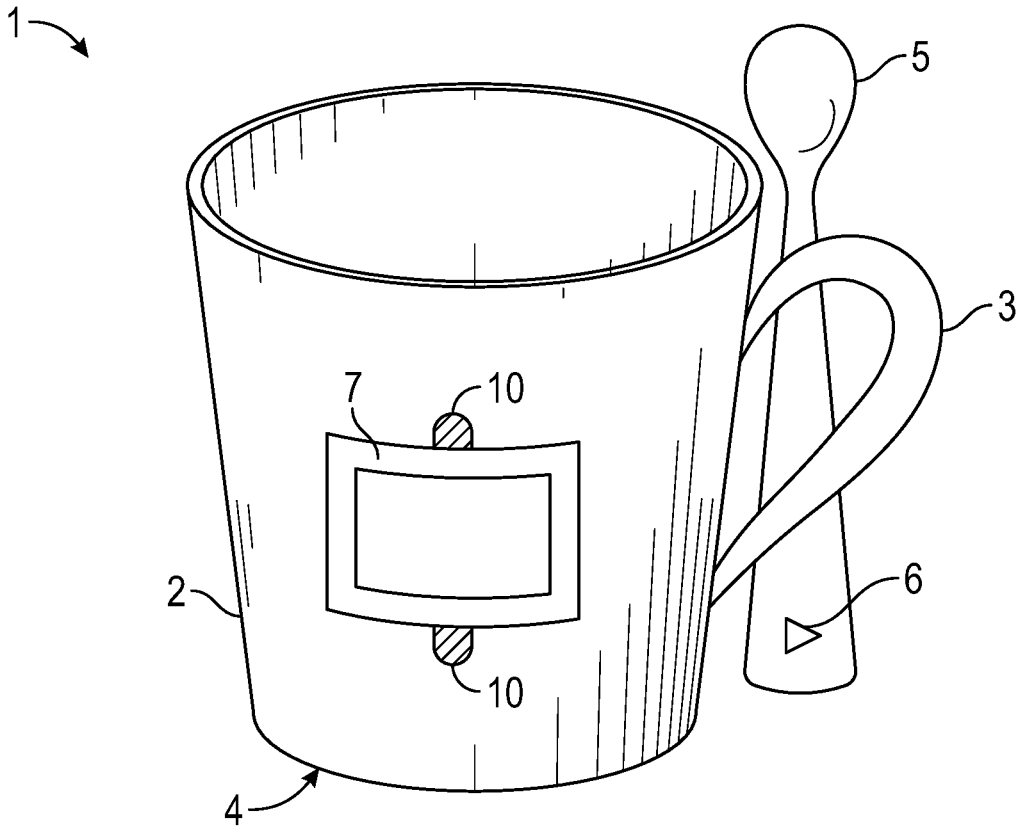
FIG. 1 depicts a drinking vessel, electronic display screen, and remote control according to an embodiment of the invention, viewed in an assembled configuration from a first side view.
Figure 2:
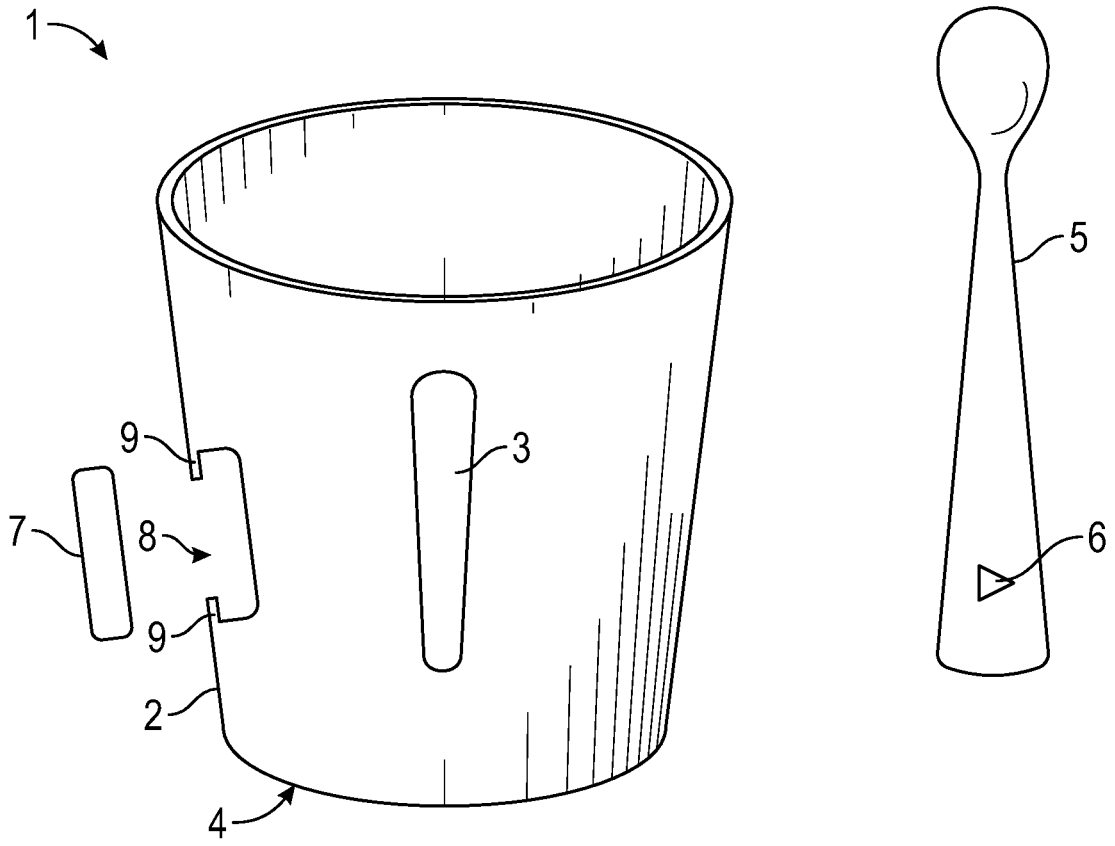
FIG. 2 depicts a drinking vessel, electronic display screen, and remote control as depicted in FIG. 1, in an exploded configuration from a second side view.
Figure 3:
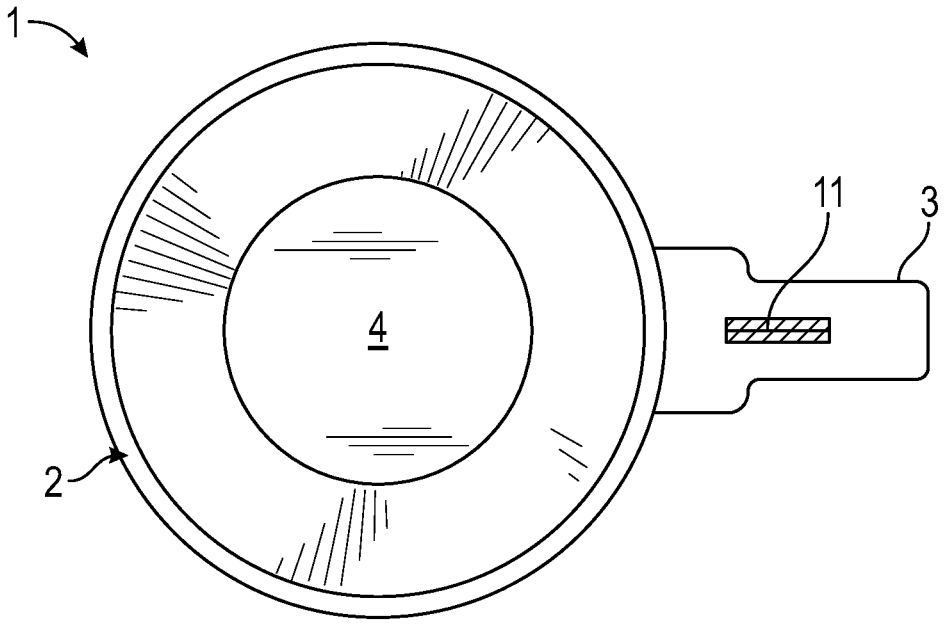
FIG. 3 depicts a drinking vessel as depicted in the first two Figures, from a top view.

FIGS. 1 to 3 depict a drinking vessel 1, in this case a mug, having a main body 2 and a handle 3. The main body 2 is configured to hold a quantity of liquid, being hollow and open at the top. The mug 1 is free standing, in that it has a substantially flat bottom surface 4 and a centre of gravity which is above the flat bottom surface 4 when in an at rest position, whether the mug 1 is full, empty, or in an intermediate state.

The mug 1 can be made of any suitable material, such as those conventionally used for mugs, including glass, metal, fired clay, or plastics. The invention is not limited to mugs, but can be embodied in any drinking vessel, and suitable materials for each selected drinking vessel will be readily derivable by the skilled reader.

The handle 3 in the depicted embodiment is a conventional loop type handle, comprising a curved gripping member attached at both ends to the outer side surface of the main body 2 of the drinking vessel 1.

A remote control 5 is provided, in this embodiment in a housing shaped like a spoon. The remote control 5 is provided with a user interface 6, which may comprise one or more buttons, touch sensitive pads, switches, or other suitable actuators or input devices.

The remote control 5 housing contains remote control circuitry (not shown). The circuitry includes a power supply and a wireless communication system.

The power supply may include a rechargeable battery. An external port (not shown) may be provided on the remote control housing 5 for connecting to an external source of electrical power for charging the rechargeable battery. Alternatively, the power supply may include a thermoelectric semiconductor, configured to convert thermal energy absorbed from the external environment (e.g. a hot drink) into electrical energy to charge the rechargeable battery. The power supply will also contain conversion circuitry suitable for the purpose.

Essential to the remote control 5 housing is that it is resistant to ingress of liquids, at least up to the maximum depth containable by the drinking vessel 1, and preferably to greater depths. It is also essential that the remote control 5 housing be resistant to heat, so as to prevent damage to remote control circuitry (not shown) contained within the remote control 5 housing when the remote control 5 is submerged in liquid heated to at least 100 degrees Celsius, and preferably higher temperatures. The user interface 6 and power supply (including any external ports) must therefore be designed so as not to compromise these essential characteristics, and should share them.

An electronic display 7 unit is also provided. This should be distinct from the drinking vessel 1, but attachable to it. It is important that the electronic display unit 7 be detachable from the drinking vessel 1 so that the drinking vessel 1 can be submerged in water for cleaning without the submersion of the electronic display unit 7.

The electronic display unit 7 is configured to display text, images, and optionally video content. It may be configured with an audio output system, such as an internal speaker (not shown) so as to output audio content as well as visual content. The electronic display unit 7 has a wireless communications interface (not shown), which may comprises wireless Internet connection, a near field communication transceiver, and/or an infra-red sensor, and/or other suitable wireless communications interface, for communication with the remote control 5.

The remote control 5 and the electronic display unit 7 are configured to communicate wirelessly, at least so that the remote control 5 can communicate instructions to the electronic display unit 7 in response to a user input at the user interface 6. The instructions may include at least instructions relating to the content displayed by the electronic display unit 7. For example, the instructions may include some or all of a. Next/Previous image;
b. Next/Previous video;
c. Stop/Pause/Play video;
d. Electronic display screen on/off;
e. Volume up/down/muted/unmuted.

The electronic display unit 7 may be attachable to the drinking vessel 1 in any suitable way. In the example depicted in FIG. 2, a recess 8 is formed in the outer side surface of the main body 2 of the drinking vessel 1, having lips 9 around at least part of its periphery, which interface with the outer edge of the electronic display unit 7 so as to form a snap-fit connection between the electronic display unit 7 and the drinking vessel 1. In such embodiments, the recess 9 will extend into at least one finger slot 10 (FIG. 1), which allows the user to grip the electronic display unit 7 when it is attached to the drinking vessel 1, in order to detach it.

In other embodiments, other touch fastening or magnetic means may be used as attachment interfaces, or any suitable means as will be apparent to the skilled reader.

The remote control 5 is preferably removably attachable to the drinking vessel 1 and/or the electronic display unit 7. In the depicted embodiment, this is achieved by providing a vertically aligned slots 11 (FIG. 3) through the handle 3, respectively proximate its first and second ends. The remote control is slidably receivable by the slots and is thereby secured to the handle 3, so as to be readily accessible to the user when required.

The remote control 5 may, of course, be attachable to the drinking vessel 1 and/or the electronic display unit 7 by any other suitable means. For example, a touch fastener or magnetic fastener may be employed.

Although the term 'drinking vessel' is used throughout this specification, the skilled person will appreciate that this does not limit the purposes for which a vessel of the invention might be used solely to drinking. It is well known, for example, that cups and beakers are commonly used for both drinking and other functions, such as storing paints and other craft accessories for children, or for holding toothbrushes or dentures. One useful application for the invention may include displaying instructional graphics or videos on the electronic display screen to guide a child through the process of teeth brushing, in which case the 'drinking vessel' may be used primarily for storing tooth brushes. Thus, the term 'drinking vessel' should be understood for the purposes of this specification as any vessel configured for use as, but not necessarily used as, a drinking vessel. The scope of the invention is not limited to this or any other embodiment. The scope of the invention is limited by the claims.

The invention claimed is:

1. A drinking vessel comprising: a first attachment interface; an electronic display unit having a display screen and comprising a second attachment interface; and a remote control comprising remote control circuitry within a remote control housing; wherein: the first and second attachment interfaces are configured to cooperate to releasably attach the electronic display unit to the drinking vessel; the remote control is operable to wirelessly transmit instructions to the electronic display unit, including instructions relating to a content displayed on the display screen; the remote control housing is resistant to ingress of liquid when submerged in liquid at least up to the maximum depth containable by the drinking vessel; and the remote control housing is resistant to heat so as to protect the remote control circuitry from damage when the remote control housing is submerged in liquids heated to up to 100 degrees Celsius.

2. A drinking vessel according to claim 1 wherein the remote control housing is sized and shaped as a spoon.

3. A drinking vessel according to claim 1, wherein the remote control housing is sized and shaped as a tea spoon.

4. A drinking vessel according to claim 1, wherein the drinking vessel comprises a third attachment interface, for the releasable attachment of the remote control housing to the drinking vessel.

5. A drinking vessel according to claim 1, wherein the electronic display unit comprises a fourth attachment interface, for the releasable attachment of the remote control housing to the electronic display unit.

6. A drinking vessel according to claim 1, wherein the remote control housing comprises a fifth attachment interface, for the releasable attachment of the remote control housing to the drinking vessel or to the electronic display unit or, if at least one is provided, to one of the third or fourth attachment interfaces.

7. A drinking vessel according to claim 1, wherein the remote control circuitry comprises a rechargeable battery and a charging circuit containing a thermoelectric semiconductor.

8. A drinking vessel according to claim 1, wherein the electronic display unit has an integral user interface.

9. A drinking vessel according to claim 8, wherein the integral user interface comprises a tilt accelerometer.

* * * * *